US012716177B2

(12) United States Patent
Lichtberger

(10) Patent No.: US 12,716,177 B2
(45) Date of Patent: Aug. 25, 2026

(54) TRACK-TAMPING MACHINE FOR COMPRESSING THE BALLAST BED OF A TRACK

(71) Applicant: HP3 Real GmbH, Vienna (AT)

(72) Inventor: Bernhard Lichtberger, Vienna (AT)

( * ) Notice: Subject to any disclaimer, the term of this patent is extended or adjusted under 35 U.S.C. 154(b) by 607 days.

(21) Appl. No.: 18/024,483

(22) PCT Filed: Sep. 6, 2021

(86) PCT No.: PCT/AT2021/060312
§ 371 (c)(1),
(2) Date: Mar. 2, 2023

(87) PCT Pub. No.: WO2022/051788
PCT Pub. Date: Mar. 17, 2022

(65) Prior Publication Data

US 2023/0313470 A1 Oct. 5, 2023

(30) Foreign Application Priority Data

Sep. 10, 2020 (AT) ..... A 50769/2020

(51) Int. Cl.
*E01B 27/17* (2006.01)

(52) U.S. Cl.
CPC ..... *E01B 27/17* (2013.01); *E01B 2203/125* (2013.01)

(58) Field of Classification Search
CPC ..... E01B 2203/125; E01B 2203/12; E01B 27/16; E01B 27/17
See application file for complete search history.

(56) References Cited

U.S. PATENT DOCUMENTS 4,627,360 A * 12/1986 Theurer ..... E01B 27/16 104/7.2
5,007,349 A 4/1991 Theurer
(Continued)

FOREIGN PATENT DOCUMENTS

AT 516311 A1 4/2016
AT 520267 A1 2/2019
(Continued)

OTHER PUBLICATIONS

EP_0564433_A1_FIT_machine_translation (Year: 2025).*

*Primary Examiner* — S. Joseph Morano
*Assistant Examiner* — Maxwell L Meshaka
(74) *Attorney, Agent, or Firm* — Tiajoloff & Kelly LLP

(57) ABSTRACT

A track-tamping machine (100) for compressing the ballast bed of a track comprises a tamping assembly group that has at least two tamping assemblies (ST), which are arranged in a row and can be moved transversely to the track-tamping machine longitudinal direction (AR) by a transverse-movement device, in order to tamp the track on each track-tamping machine side (R, L). The tamping assembly group (V, H) is rotatably mounted on a support (18) for the purpose of a rotational adjustment about a track-tamping machine vertical axis (A). At least two tamping assembly groups (V, H) are arranged one behind the other in the track-tamping machine longitudinal direction (A, R), said groups being rotatably mounted about the track-tamping machine vertical axis (A) via a common rotational device (2), wherein the tamping assemblies (ST) of the tamping assembly groups (V, H) can be moved independently of one another transversely to the track-tamping machine longitudinal direction (AR) and can be lifted and lowered relative to the consoles (3) independently of one another.

8 Claims, 3 Drawing Sheets

(56) References Cited

Figure 1:
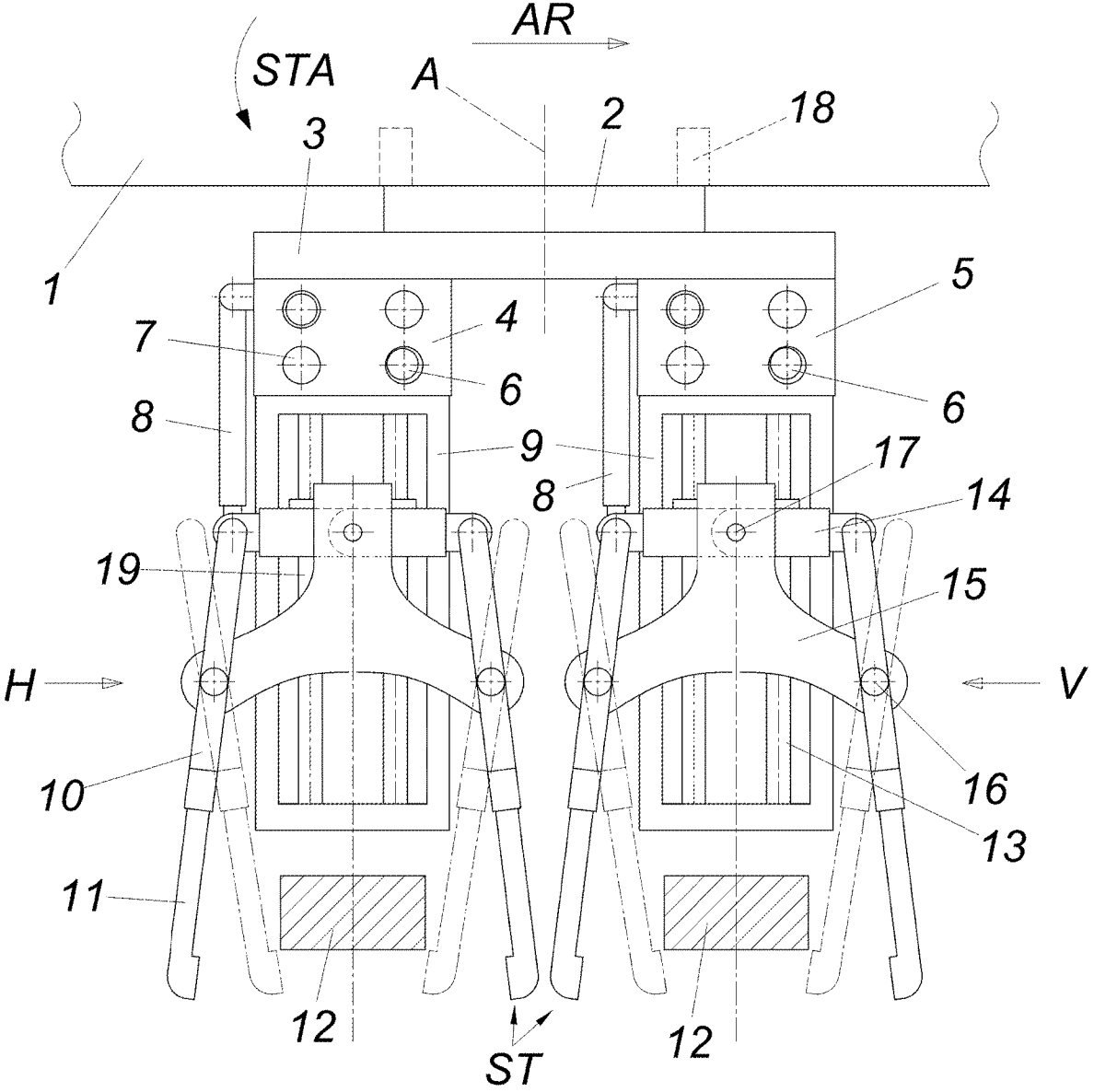

U.S. PATENT DOCUMENTS 5,269,226 A * 12/1993 Theurer ..... E01B 27/16 104/12
5,329,856 A 7/1994 Lorscheider
5,493,499 A * 2/1996 Theurer ..... G01S 19/14 73/146
5,591,915 A * 1/1997 Theurer ..... E01B 35/00 73/146
5,706,734 A 1/1998 Theurer
6,058,628 A * 5/2000 Theurer ..... E01B 27/023 104/2
6,154,973 A * 12/2000 Theurer ..... E01B 27/17 33/651
6,311,624 B1 * 11/2001 Theurer ..... E01B 35/10 104/2
6,453,822 B2 * 9/2002 Theurer ..... E01B 35/04 104/7.2
6,546,876 B2 * 4/2003 Theurer ..... E01B 27/17 104/7.2
6,662,728 B2 * 12/2003 Theurer ..... E01B 35/00 104/2
6,705,232 B2 3/2004 Theurer et al.
7,383,777 B2 * 6/2008 Theurer ..... E01B 27/16 104/12
9,631,325 B2 * 4/2017 Lichtberger ..... E01B 27/17
9,957,668 B2 * 5/2018 Lichtberger ..... E01B 27/16
10,100,469 B2 * 10/2018 Lichtberger ..... E01B 27/16
10,174,461 B2 * 1/2019 Lichtberger ..... E01B 35/08
10,208,432 B2 * 2/2019 Seyrlehner ..... B06B 1/18
10,240,300 B2 3/2019 Lichtberger
10,550,525 B2 * 2/2020 Lichtberger ..... E01B 27/17
10,794,009 B2 * 10/2020 Lichtberger ..... E01B 27/17
11,713,547 B2 * 8/2023 Lichtberger ..... E01B 27/16 104/10
11,807,995 B2 * 11/2023 Lichtberger ..... E01B 27/16
11,982,056 B2 * 5/2024 Lichtberger ..... E01B 27/17
2001/0027732 A1 * 10/2001 Theurer ..... E01B 27/17 104/10
2001/0050021 A1 * 12/2001 Theurer ..... E01B 27/17 104/2
2003/0029350 A1 * 2/2003 Theurer ..... E01B 35/00 104/2
2004/0003750 A1 1/2004 Theurer et al.
2006/0090666 A1 * 5/2006 Theurer ..... E01B 27/16 104/12
2015/0368865 A1 * 12/2015 Lichtberger ..... E01B 27/17 104/7.2
2016/0010287 A1 * 1/2016 Lichtberger ..... E01B 27/16 104/10
2016/0273170 A1 9/2016 Hofer et al.
2017/0268180 A1 * 9/2017 Lichtberger ..... E01B 35/08
2017/0275828 A1 * 9/2017 Seyrlehner ..... E01B 27/17
2017/0284033 A1 * 10/2017 Lichtberger ..... E01B 27/17
2017/0328013 A1 * 11/2017 Lichtberger ..... E01B 35/00
2018/0274179 A1 9/2018 Lichtberger
2018/0298564 A1 * 10/2018 Lichtberger ..... E01B 27/17
2020/0157745 A1 5/2020 Seyrlehner
2021/0002831 A1 * 1/2021 Lichtberger ..... E01B 27/16
2021/0010206 A1 * 1/2021 Lichtberger ..... E01B 27/16
2021/0222373 A1 * 7/2021 Lichtberger ..... E01B 29/04
2022/0349128 A1 * 11/2022 Lichtberger ..... E01B 27/023
2023/0228042 A1 * 7/2023 Lichtberger ..... E01B 35/00 104/12
2023/0313470 A1 * 10/2023 Lichtberger ..... E01B 27/17 104/10
2024/0271370 A1 * 8/2024 Lichtberger ..... E01B 27/17
2024/0360631 A1 * 10/2024 Lichtberger ..... E01B 27/20

FOREIGN PATENT DOCUMENTS

CA 2090396 A1 10/1993
CN 1077509 A * 10/1993 ..... E01B 27/17
CN 107148501 A * 9/2017 ..... E01B 27/17
EP 0386398 A1 9/1990
EP 0564433 A1 10/1993
EP 0775779 A1 5/1997
EP 1001085 A1 * 5/2000 ..... E01B 35/10
FR 2690935 A1 * 11/1993 ..... E01B 27/17
WO WO-2018065080 A1 * 4/2018 ..... E01B 27/16
WO WO-2022002521 A1 * 1/2022 ..... E01B 27/17

* cited by examiner

TRACK-TAMPING MACHINE FOR COMPRESSING THE BALLAST BED OF A TRACK

FIELD OF THE INVENTION

The invention relates to a track-tamping machine for compressing the ballast bed of a track, comprising a tamping assembly group which has at least two tamping assemblies, which are arranged in a row and can be displaced transversely with respect to the longitudinal direction of the track-tamping machine by means of a transverse-movement device, in order to tamp the track on each side of the track-tamping machine, of which the respective outer tamping assembly can be displaced in a console with guides assigned to it by means of an adjusting drive transversely with respect to the track-tamping machine longitudinal direction, and the inner tamping assembly is displaceable on the same guides and in the same console independently of the outer tamping assembly with an adjusting drive transversely to the track-tamping machine longitudinal direction as far as the outer tamping assembly, wherein the tamping assembly group is rotatably mounted on a carrier for the purpose of rotary adjustment about a track-tamping machine vertical axis.

DESCRIPTION OF THE PRIOR ART

AT 516 311 A1 discloses a track-tamping machine of this type. Guiding columns are guided in the console with which the tamping assemblies of the tamping assembly groups, forming so-called splithead units, are fixedly connected. The respective inner tamping assemblies slide on these common slide rods or slide tubes. The movements are made by transverse sliding drives. This design allows the inner lateral unit to be displaced transversely up to the limit of the outer lateral unit. According to the invention, the slide rods or slide tubes of the left-hand and right-hand units are arranged spatially independently of one another and guided in the console in such a way that they do not interfere with one another and that the at least two guide rods or guide tubes in each case are mounted vertically in height relative to one another not only in the longitudinal direction of the track but also vertically. As a result of this embodiment according to the invention, a substantially higher vertical stiffness, stiffness in the longitudinal direction of the track and torsional stiffness are achieved. It is also provided that the slide rods or slide tubes can extend outward through holes in the unit frames of the respective opposite units, thus making the best possible use of the permissible clear space of the rail tracks. Long transverse adjustment paths are achieved by this design.

A tamping machine that runs continuously in operation is known, for example, from U.S. Pat. No. 6,705,232. The great advantage of this type of tamping machine is that the main machine, with a much larger mass, does not have to be stopped and then re-accelerated at each sleeper to be tamped. This increases the working speed of the machine compared to cyclic machines and also reduces the accelerations acting on the machinist. The cyclic advance from sleeper area to sleeper area is limited to the satellite carrying the working units, which is designed to be longitudinally displaceable relative to the main frame of the machine. Such a machine is also disclosed from AT401943B.

Tamping assemblies fix the position of a track during a maintenance measure. This is carried out by tamping tools, so-called tamping tines, which plunge into the ballast next to the sleepers and compact the ballast underneath the sleeper by means of a linear closing movement superimposed by a compaction vibration. There are tamping machines specialized in tamping switches (with separable tamping assemblies—the so-called splithead units, with additional lifting devices for the branching track and pivotable tamping tines, etc.) and tamping machines that are preferably built for track tamping. Tamping machines are known to operate cyclically but also continuously. In addition, there are single-sleeper and multi-sleeper tamping machines. Multi-sleeper tamping machines tamp several sleepers at once in one working cycle. However, some can also be used in such a way that only one sleeper is tamped.

AT520 267 A1 shows a design in which two tamping assemblies that can be raised and lowered independently are provided on a jointly movable tamping assembly frame. In switches, this type of design has the major disadvantage that usually only one of the pairs of units on one side can be lowered because the other, since it cannot be moved independently, is obstructed by obstacles such as rails, frog, tongue device, wing rails, etc. when the working tools are dipped.

Common universal continuously operating switch tamping machines are equipped with four splithead units (two on each side—one inner and one outer) with pivotable tines. The advantage of these machines is their great flexibility in switches. On the other hand, there are also continuously operating twin-head tamping machines. These have a greater working capacity for track tamping, but they have the disadvantage that in the complex switch area (frog/tongue area), it is only possible to work with one pair of units or with the tines pivoted up for the most part.

Well tamped track must be tamped on the left and right side of the rail. Therefore, in the first operation, the main track is tamped and in the branching track of the switch, only the branching outer rail of the branch is tamped on one side. In a second operation, the areas that could not be tamped in the first operation are tamped. In the switch, an outer splithead unit tamps the branching track, while the inner unit partially tamps the inner track. During the second operation, the operator must therefore remember where he has already tamped along the inside or outside of the track progression. Repeated tamping of the same point causes irregularities in the track geometry.

SUMMARY OF THE INVENTION

The invention is based on the object of avoiding the above-mentioned disadvantages and specifying a device which is equally suitable for track tamping and switch tamping with good tamping performance.

The invention solves the object in that at least two tamping assembly groups are arranged one behind the other in the track-tamping machine longitudinal direction and are rotatably mounted about the track-tamping machine vertical axis by means of a common rotational device, wherein the tamping assemblies of the tamping assembly groups can be moved independently of one another transversely to the track-tamping machine longitudinal direction and can be raised and lowered independently of one another relative to the console.

Thus, the at least two left-hand and the at least two right-hand tamping assemblies of both tamping assembly groups can be displaced independently of each other transversely to the longitudinal direction of the track-tamping machine and raised and lowered independently of each other relative to the console. In addition, the tamping assemblies of the tamping assembly groups are rotatably mounted about the track-tamping machine vertical axis by means of a common rotational device. This measure ensures that the device can perform just as well in track tamping as in switch tamping. Once the tamping assemblies have been pushed together to form a console and moved to a neutral position via the rotational device, the machine is set for track tamping, wherein the tamping performance is adjustable with the number of tamping assembly groups. Each tamping assembly group tamps one sleeper in one working cycle.

In switches, the position of the tamping assemblies can be adjusted due to their transverse displaceability in such a way that all tamping assemblies can tamp simultaneously. If there is an obstacle under a tamping assembly, it is simply positioned in an obstacle-free area or not lowered for tamping if tamping is not possible at this position. Another major advantage is that, for example, the front tamping assembly group can completely tamp the continuous main track while the rear tamping assembly group processes the branching track or vice versa. Between the tamping cycles, for example, the machine is then advanced only from one sleeper to the next and not, as in track tamping, over two or more sleepers, depending on the number of tamping assembly groups. This means that only a very small number of sleepers remain to be tamped in the branching track for the second pass, namely only those that lie outside the range of the transversal displacement. This leads to an increase in work output, a considerably better switch position and work quality. Since the tamping assembly groups can be rotated together via the rotational device, it is possible to align the tamping assemblies in switch areas in such a way that they can be transversely displaced parallel to obliquely lying long sleepers. The device according to the invention can be used both on cyclically operating universal tamping machines and on continuously operating double or multiple sleeper tamping machines.

According to an advantageous further development of the invention, the tamping assembly groups can be displaced between track-tamping machine undercarriages with an adjusting drive in the longitudinal direction of the track-tamping machine within a displacement range provided between the track-tamping machine undercarriages. This allows the tamping assembly groups to be positioned precisely in the longitudinal direction of the track-tamping machine on the one hand, and a continuously operating track-tamping machine on the other. A satellite carrying the rotational device and the console can be moved in particular between the track-tamping machine undercarriages. The satellite carries the tamping assembly groups and, optionally, a track-lifting straightening unit. Such a universal tamping machine can be used both for track tamping with high tamping capacities and specifically for switch tamping.

If at least three tamping assembly groups are arranged one behind the other in the longitudinal direction of the track-tamping machine, more than two sleepers can be tamped in one working cycle.

To improve rigidity and create compact design conditions, at least two guides per pair of tamping assemblies and per track-tamping machine side can be mounted in the console, which guides are offset from each other in the longitudinal direction of the track-tamping machine and in the direction of a track-tamping machine vertical axis. One console can be provided for each tamping assembly group or a common console can accommodate the tamping assembly groups.

In order to be able to advantageously avoid any obstacles, it is advantageous if the tamping assemblies for a switch tamping are equipped with tines that can be pivoted around a longitudinal axis of the track-tamping machine.

BRIEF DESCRIPTION OF THE INVENTION

Figure 2:
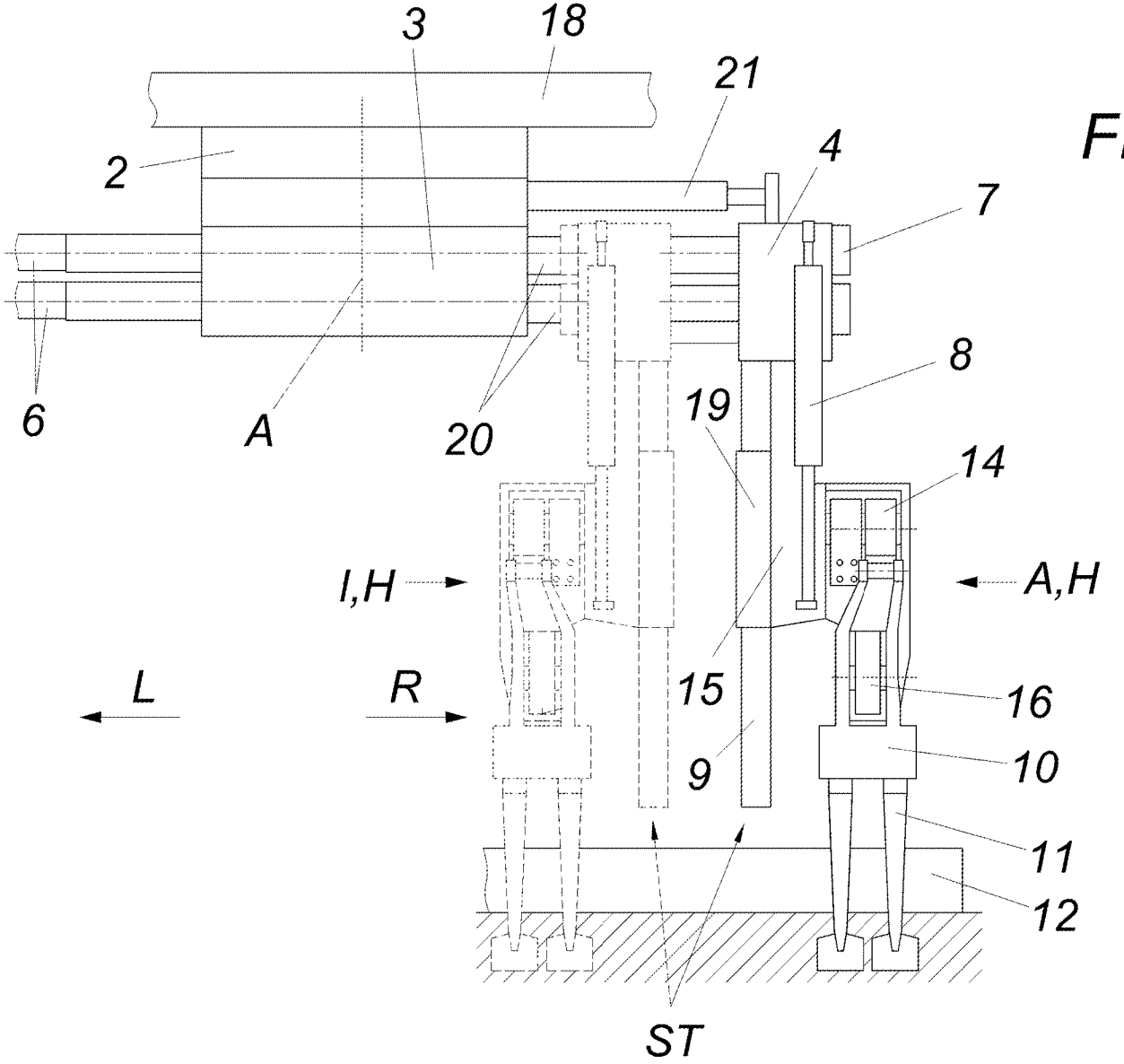
Figure 3:
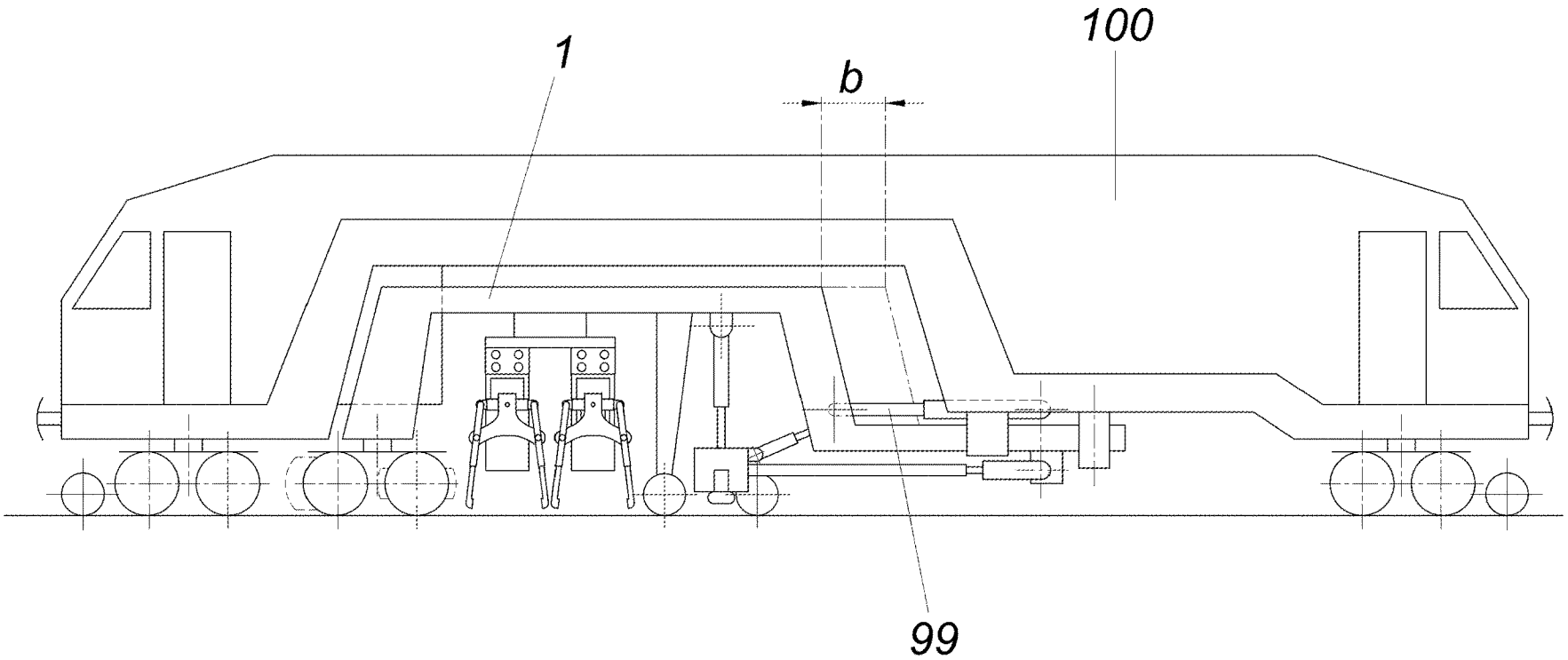

In the drawing, the subject matter of the invention is shown by way of example, wherein:

FIG. 1 shows a side view of two tamping assembly groups arranged on a track-tamping machine, FIG. 2 shows a view of the right side of a tamping assembly group arranged on a track-tamping machine, and FIG. 3 shows a side view of a continuously operating track-tamping machine with two tamping assembly groups.

DETAILED DESCRIPTION OF THE PREFERRED EMBODIMENTS

The track-tamping machine 100 for compressing the ballast bed of a track comprises at least two tamping assembly groups V, H, each having at least two tamping assemblies ST for tamping the track per track-tamping machine side R, L, which can be displaced transversely to the track-tamping machine longitudinal direction AR by means of a transverse-movement device and are arranged in a row, of which the respective outer tamping assembly can be displaced in a console with guides assigned to it by means of an adjusting drive 21 transversely to the track-tamping machine longitudinal direction AR. The inner tamping assembly can be displaced on the same guides and in the same console 3 independently of the outer tamping assembly with an adjusting drive transversely to the track-tamping machine longitudinal direction AR as far as the outer tamping assembly ST. The tamping assembly groups V, H are jointly mounted on a carrier 18 so as to be rotatable about a track-tamping machine vertical axis A for the purpose of rotary adjustment.

The at least two tamping assembly groups V, H are arranged one behind the other in the track-tamping machine longitudinal direction AR and are rotatably mounted about the track-tamping machine vertical axis by means of a common rotational device 2. In addition, the individual tamping assemblies of the tamping assembly groups can be displaced independently of one another transversely to the track-tamping machine longitudinal direction AR and can be raised and lowered independently of one another with respect to the console 3.

In addition, the tamping assembly groups V, H can be displaced between track-tamping machine undercarriages by means of an actuator in the longitudinal direction of the track-tamping machine within a provided displacement range between the track-tamping machine undercarriages.

At least two guides 6, 20 per pair of tamping assemblies LHA with LHI, RHA with RHI, LVA with LVI, RVA with RVI and per track-tamping machine side are mounted in the console 2, which guides 6, 20 are offset from one another in the longitudinal direction of the track-tamping machine and in the direction of a track-tamping machine vertical axis. The tamping assemblies ST are equipped with tines 11 that can be pivoted about a longitudinal axis of the track-tamping machine for tamping switches.

FIG. 1 shows the arrangement of two tamping assembly groups H (rear) and V (front) arranged one behind the other in the longitudinal direction of the track-tamping machine AR, with tamping assemblies I (inside) and A (outside) from the side in the longitudinal direction of the track. FIG. 2 shows a schematic view in the longitudinal direction of the track-tamping machine AR, with only the right-hand two tamping assemblies I, A of the rear tamping assembly group H shown.

Cross beams 18 are attached to a frame of a satellite 1 and support a slewing ring of the rotational device 2. The rotational device is connected to the console 3 for the columns of the guides 6, 20. The guides 20 of a pair of tamping assemblies, e.g. a rear one, consisting of the rear inner tamping assembly H, I and the rear outer tamping assembly H, A, are connected to unit frames 4, 9 of the outer tamping assembly in the region 7. The respective inner tamping assembly HI, VI can be moved on these guides 20. Drives 21 allow the tamping assemblies to be displaced transversely independently of each other in the longitudinal direction of the track. The guides 20 are arranged in such a way that two of them are opposite each other. To make full use of the available space, recesses 6 are provided in each of the unit frames 4, 5 into which the guides of the assembly pair L or R on the other side can slide freely.

The tamping assemblies consist of tamping arms 10 in which tamping tines 11 are fastened. The tamping arms 10 are mounted on the tamping box 15 so that they can rotate about an axis 16. The tamping drives 14 engage at the other end of the tamping arms. The tamping drives 14 have one or more engagement points 17 in the tamping box 15. The tamping drives can be designed as a pure linear drive or as an eccentric shaft drive with auxiliary cylinders. For reasons of clarity, the tamping assemblies with laterally pivoting tines 11 are not shown. The tamping boxes move up and down on vertical guides 13 mounted in the tamping box frame 9. This allows the tamping assemblies to be raised and lowered individually and independently of each other with respect to the console 3. The tamping assemblies can be lowered and raised independently of one another via drives 8. Two sleepers 12 are shown which can be processed in one operation. A drive unit mounted on the slewing ring 2 can be used to adjust the entire tamping arrangement to oblique long sleepers in parallel.

The invention claimed is:

1. A track-tamping machine for compressing the ballast bed of a track, said track-tamping machine comprising:

at least two tamping assembly groups;

each tamping assembly group having at least two tamping assemblies, said tamping assemblies being arranged in a row and supported for transverse movement with respect to a track-tamping machine longitudinal direction by a transverse-movement device, so as to tamp the track on left and right sides of the track-tamping machine;

wherein each of the tamping assemblies includes a respective outer tamping assembly with guides associated therewith, wherein the respective outer tamping assembly and the guides thereof being together displaced by an adjusting drive transversely with respect to the track-tamping machine longitudinal direction with the guides movably supported in a console; and a respective inner tamping assembly supported so as to be displaceable on the guides independently of the outer tamping assembly transversely to the track-tamping machine longitudinal direction as far as the respective outer tamping assembly;

wherein each of the tamping assembly groups is rotatably mounted on a carrier so as to provide rotary adjustment about a track-tamping machine vertical axis;

wherein the at least two tamping assembly groups are arranged one behind the other in the track-tamping machine longitudinal direction and are rotatably mounted about the track-tamping machine vertical axis by a common rotational device; and wherein the tamping assemblies of the tamping assembly groups are supported so as to be moved independently of one another transversely to the track-tamping machine longitudinal direction and so as to be raised and lowered independently of one another relative to the console; and wherein the tamping assemblies have at least two guides per pair of said tamping assemblies and per side of the track-tamping machine mounted in the console, said guides being offset relative to one another in the track-tamping machine longitudinal direction and in the direction of a track-tamping machine vertical axis.

2. The track-tamping machine according to claim 1, wherein the tamping assembly groups are supported for displacement between track-tamping machine undercarriages by an adjusting drive in the track-tamping machine longitudinal direction within a predetermined displacement range between the track-tamping machine undercarriages.

3. The track-tamping machine according to claim 1, wherein the track-tamping machine has at least three tamping assembly groups arranged one behind the other in the track-tamping machine longitudinal direction so as to tamp more than two sleepers in one working cycle.

4. The track-tamping machine according to claim 1, wherein where any of the tamping assemblies that are used for switch tamping are equipped with tines supported so as to be pivoted about a track-tamping machine longitudinal axis.

5. The track-tamping machine according to claim 2, wherein the track tamping machine has at least three tamping assembly groups arranged one behind the other in the track-tamping machine longitudinal direction so as to tamp more than two sleepers in one working cycle.

6. The track-tamping machine according to claim 2, wherein where any of the tamping assemblies that are used for switch tamping are equipped with tines supported so as to be pivoted about a track-tamping machine longitudinal axis.

7. The track-tamping machine according to claim 3, wherein where any of the tamping assemblies that are used for switch tamping are equipped with tines supported so as to be pivoted about a track-tamping machine longitudinal axis.

8. The track-tamping machine according to claim 5, wherein where any of the tamping assemblies that are used for switch tamping are equipped with tines supported so as to be pivoted about a track-tamping machine longitudinal axis.

* * * * *